United States Patent [19]

Juve

[11] 4,377,986

[45] Mar. 29, 1983

[54] HOIST PLATING LINE

[76] Inventor: Robert J. Juve, 34623 Moravian Dr., Sterling Heights, Mich. 48077

[21] Appl. No.: 161,607

[22] Filed: Jun. 20, 1980

[51] Int. Cl.[3] ..... B05C 3/09

[52] U.S. Cl. ..... 118/696; 118/425; 414/222; 134/76

[58] Field of Search ..... 118/425, 663, 696, 697; 134/76, 77, 135, 133; 414/222, 560

[56] References Cited

U.S. PATENT DOCUMENTS

| | | | |
|---|---|---|---|
| 2,048,937 | 7/1936 | Larson | 118/425 X |
| 2,106,706 | 2/1938 | Gordon | 134/77 X |
| 3,658,197 | 4/1972 | Didonato | 118/425 X |
| 3,691,988 | 9/1972 | Clarke | 118/425 X |
| 3,923,071 | 12/1975 | Lada | 118/425 X |
| 3,986,518 | 10/1976 | Sato | 118/425 X |

*Primary Examiner*—John P. McIntosh

*Attorney, Agent, or Firm*—Barnes, Kisselle, Raisch, Choate, Whittemore & Hulbert

[57] ABSTRACT

A hoist plating line comprising a plurality of plating tanks disposed in a linear array and an elongated track extending longitudinally above the tanks and including means for bodily moving the track between raised and lowered positions above the tanks. A plurality of carts are mounted on the track and are coupled by drive chains to electric motors disposed at one of the track ends for translating the carts longitudinally of the track above the tanks in both the raised and lowered positions of the track. The carts include carrier hands adapted to cooperate with pick-up adapters associated with workpieces suspended in the various tanks for lifting, translating and depositing the workpieces among the plating tank locations. A plurality of proximity detectors are spaced longitudinally of the track and cooperate with the carts for identifying plating locations associated with the various tanks disposed beneath the track.

10 Claims, 7 Drawing Figures

HOIST PLATING LINE

The present invention is directed to material finishing process lines, and more particularly to a hoist-type material plating line and to an improved hoist for use therein.

An object of the present invention is to provide a hoist for a material finishing line which is more rapid and economical in operation than are the chain-type hoists characteristic of material finishing lines in the prior art. A further object of the invention is to provide a hoist of the described type which may be readily upwardly or downwardly scaled to accommodate material finishing lines of varying complexity and dimension.

Another object of the invention is to provide a hoist-type material finishing line, and particularly a hoist plating line, which includes the improved hoist of the invention. A further and related object is to provide a plating line of the described type wherein electrical components, such as motors and cables, are removed from the region or zone above the plating tanks. Yet another object of the invention is to provide a hoist plating line of the type comprising a linear series of tanks wherein the hoist is capable of simultaneously servicing longitudinally adjacent tanks.

A further and more specific object of the invention is to provide a hoist for a plating line having a plurality of plating positions wherein the hoist includes means for identifying each of such positions and in which corrosion and failure problems of the mechanical switch arrangements of the prior art are eliminated.

The invention, together with additional objects, features and advantages thereof, will be best understood from the following description, the appended claims and the accompanying drawings in which:

Figure 1:
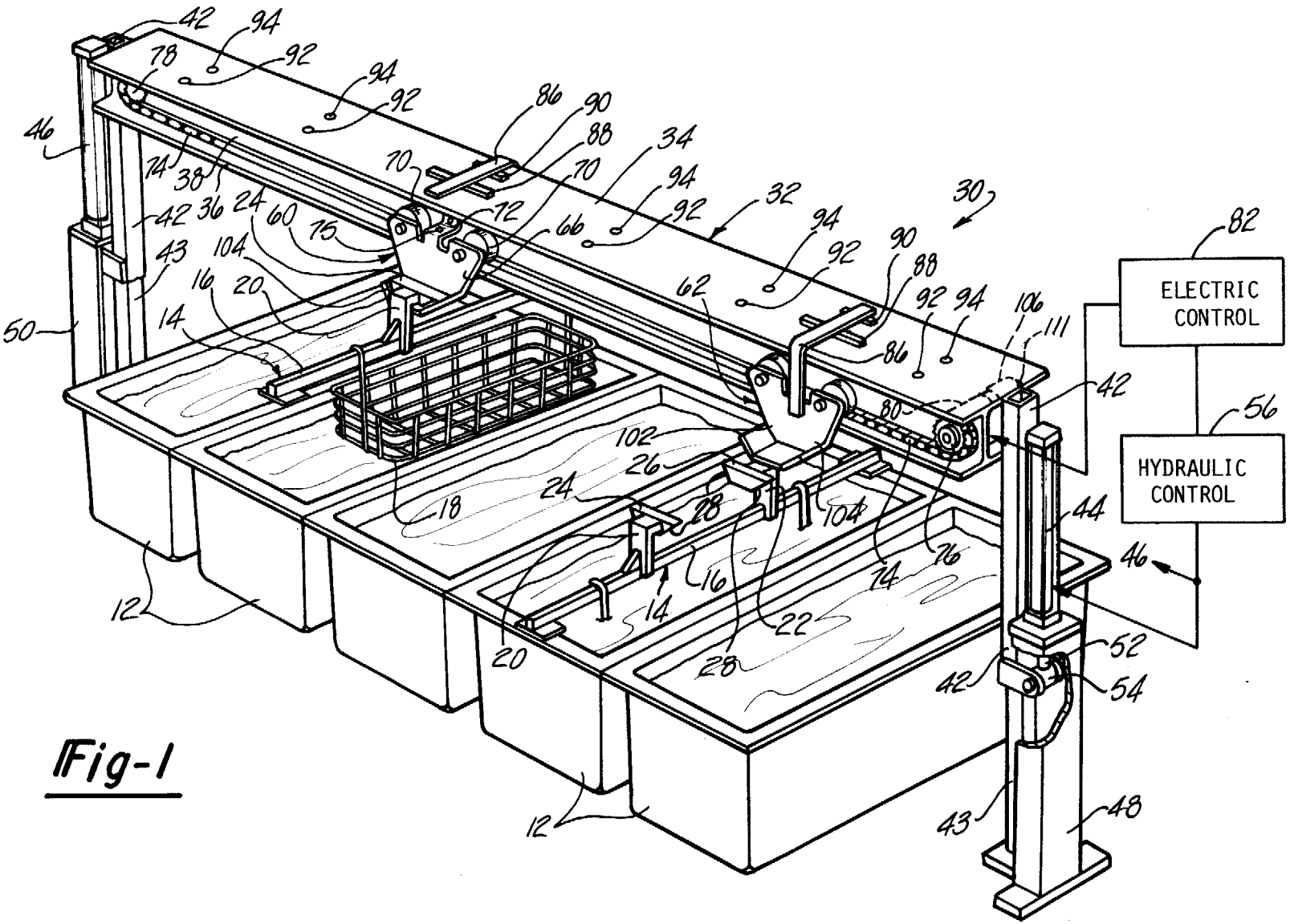
FIG. 1 is a perspective view of a plating line and hoist in accordance with one embodiment of the present invention.
Figure 2:
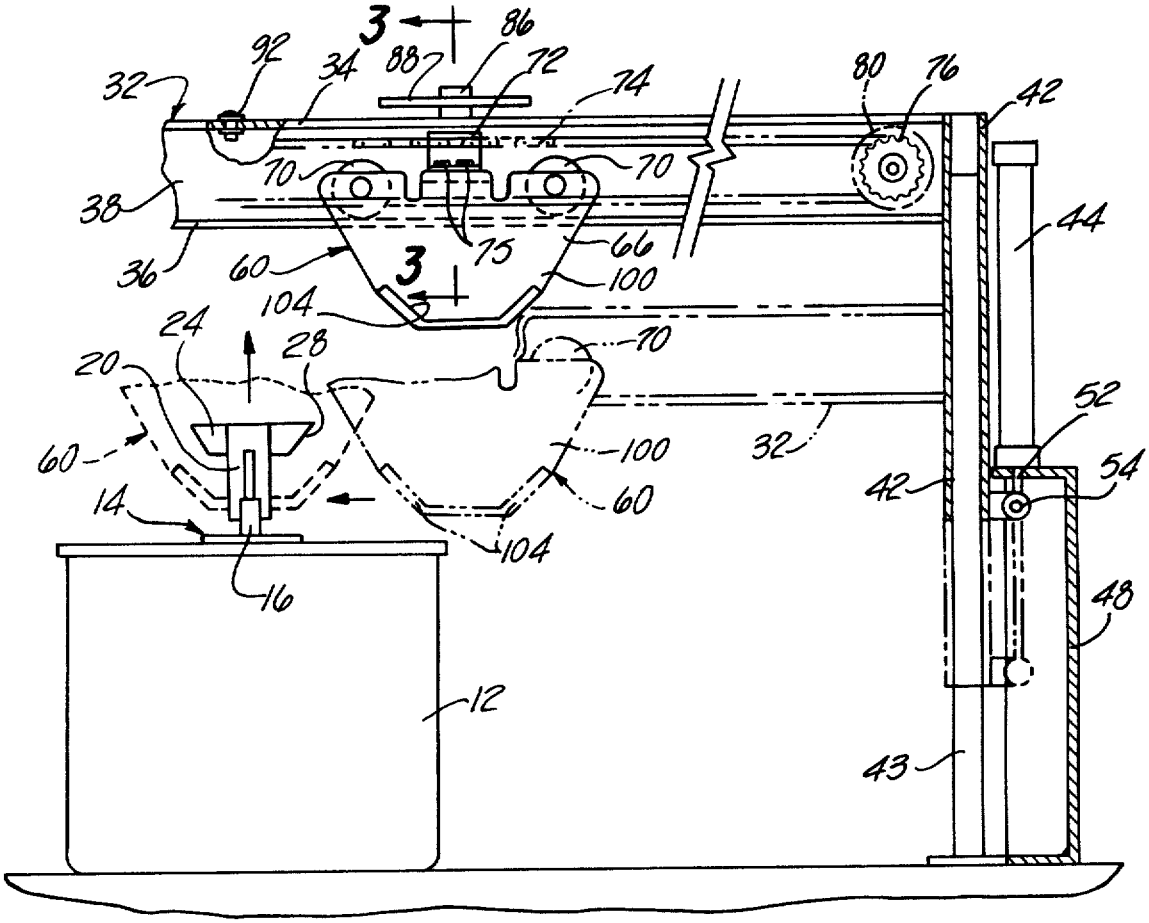
FIG. 2 is a fragmentary elevational view partially in section of a portion of the plating line illustrated in FIG. 1.
Figure 3:
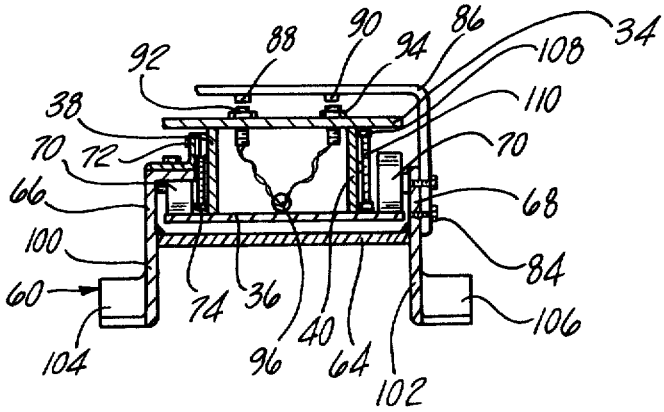
FIG. 3 is a sectional view taken along the line 3—3 in FIG. 2.

FIGS. 1-3 illustrate a hoist plating line embodying the invention as comprising a plurality of plating tanks 12 disposed in a linear array closely adjacent each other as is desirable to conserve floor space. Each tank 12 is adapted to contain a suitable plating liquid, such as an acid bath, plating solution or rinse, etc. A plurality of carriers 14 are adapted to suspend workpieces in plating tanks 12. Each carrier 14 comprises a carrier bar 16 of a length adapted to span the width of plating tanks 12, i.e. the dimension transverse to the longitudinal dimension of the tank array, and means such as the basket 18 or barrel 118 (FIG. 6) depending from the bar 16 for immersing workpieces in the plating liquids. A pair of laterally spaced pick-up adapters 20,22 are affixed to each carrier bar 16 and extend upwardly therefrom.

Pick-up adapters 20,22 include respective pick-up arms 24,26 oppositely cantilevered from adapters 20,22 on an axis parallel to carrier bar 16. In the embodiment illustrated in FIG. 1, the pick-up arms 24,26 are cantilevered inwardly toward each other and are generally T-shaped in configuration with lateral ends of each pick-up arm 24,26 terminating in the downwardly and inwardly sloping side pick-up faces 28.

Spanning tanks 12 in accordance with the invention is a single-beam hoist 30. Hoist 30 includes an elongated track 32 in the form of a hollow I-beam, as best seen in FIG. 3, comprising upper and lower track plates 34,36 spanning and extending laterally outwardly from the beam side plates or walls 38,40. Plates 34–40 are welded to each other so as to constitute a rigid beam assembly. A pair of hollow rectangular support legs 42 (FIGS. 1 and 2) are mounted by swivels (not shown) and depend from opposite longitudinal ends of track 32 and are telescopically received over the fixed guide bars 43. A pair of hydraulic or air cylinders 44,46 are mounted adjacent the longitudinal ends of track 32 on the respective fixed supports or stanchions 48,50 and have the respective actuator arms or rods 52 (shown for cylinder 44 only) coupled as by the pivotal linkages 54 to the lower ends of the respective support legs 42. Thus, actuation of the hydraulic cylinders 44,46 as by the hydraulic control 56 (shown in block form in FIG. 1) causes the track 32 to move bodily in a vertical plane above tanks 12 between a lower position illustrated in phantom in FIG. 2 and a raised or upper position illustrated in solid lines in FIG. 2 and FIG. 1. Hydraulic cylinders 44,46 are controlled to actuate substantially simultaneously in both directions so that the track 32 is at all times carried substantially horizontally above the array of tanks 12. A level sensing means (not shown) is used to control hydraulic cylinders. Guide bars 43 cooperate with support legs 42 to maintain horizontal orientation or track 32 and to prevent rocking of track 32 about its horizontal axis.

A pair of carts 60,62 are carried by track 32 for longitudinal movement above tanks 12. Cart 60 includes a body of two castings 66 and 68 or the like held together by a portion 64 (FIG. 3) which extends beneath lower beam plate 36 and terminates laterally of the beam in upwardly extending flanges 66,68 on either side of the beam lower plate. A pair of longitudinally spaced free-wheeling castors 70 are mounted internally of each flange 66,68 and rest upon the upper surface of lower beam plate 36 externally of beam side walls 38, 40. Between upper beam plate 34 and lower beam plate 36, flange 66 is coupled by an L-bracket 72 mounted thereto by the bolts 75 to opposite ends of a drive chain 74. Chain 74 extends adjacent side walls 38 for the length of track 32 and is looped at opposing track ends over the sprockets 76,78. Sprocket 78 is mounted for free-wheeling rotation. Sprocket 76 is coupled to a drive motor 80 mounted internally of track 32. Motor 80 is operatively connected to an electrical control circuit 82 (FIG. 1) for selectively translating cart 60 through drive chain 74 along track 32 above tanks 12.

Externally mounted to flange 68 as by the bolts 84 is an arm 86 which extends upwardly and then laterally over upper beam plate 34. Mounted beneath the laterally extending portion of arm 86 are a pair of laterally spaced longitudinally extending fingers 88,90 of magnetically permeable material. A longitudinal array of electromagnetic proximity detectors is mounted to beam upper plate 34 in laterally aligned pairs 92,94 at longitudinal positions corresponding to the locations of tanks 12 beneath track 32. Detectors 92,94 cooperate with fingers 88,90 carried by cart 60 for identifying the position of cart 60 with respect to the plating locations of tanks 12. In particular, finger 88 is of greater dimension in both longitudinal directions than is finger 90 and cooperates with successive detectors 92 disposed therebeneath for indicating approach of cart 60 to the various plating locations, while the finger 90 cooperates with successive detectors 94 disposed therebeneath to indicate that the cart 60 has arrived at the associated locations. Proximity detectors 92,94 are coupled as by the electrical cable 96 (FIG. 3) which extends internally of track 32 to electric control 82 (FIG. 1). Control 82 preferably is responsive to detectors 92 for slowing cart 60 as it approaches the desired location and to detectors 94 for stopping cart 60 at the desired location.

Depending from cart 60 as an integral extension of each cart flange 66,68 is a respective pick-up hand 100,102. Longitudinally spaced inwardly and downwardly angulated flanges 104, 106 integrally extend laterally outwardly of hands 100,102, and are adapted to engage surfaces 28 and thereby cooperate with the pick-up adapters 20,22 on carrier bar 16 for lifting the carrier bar and the workpieces suspended therefrom from the tanks 12 and translating the workpieces longitudinally of track 32 among the various tank positions. Cart 62 is identical to cart 60 although mounted to track 32 in the laterally opposite sense so as to be driven by the motor 106 (FIG. 1) and the chain 108 (FIG. 3) looped over the sprockets 110,111 on the side of track 32 opposite to that of chain 74. Hydraulic control 56 (FIG. 1) is operated by electric control 82, which may comprise any suitable electronic or electromechanical programmable controller.

Figure 5:
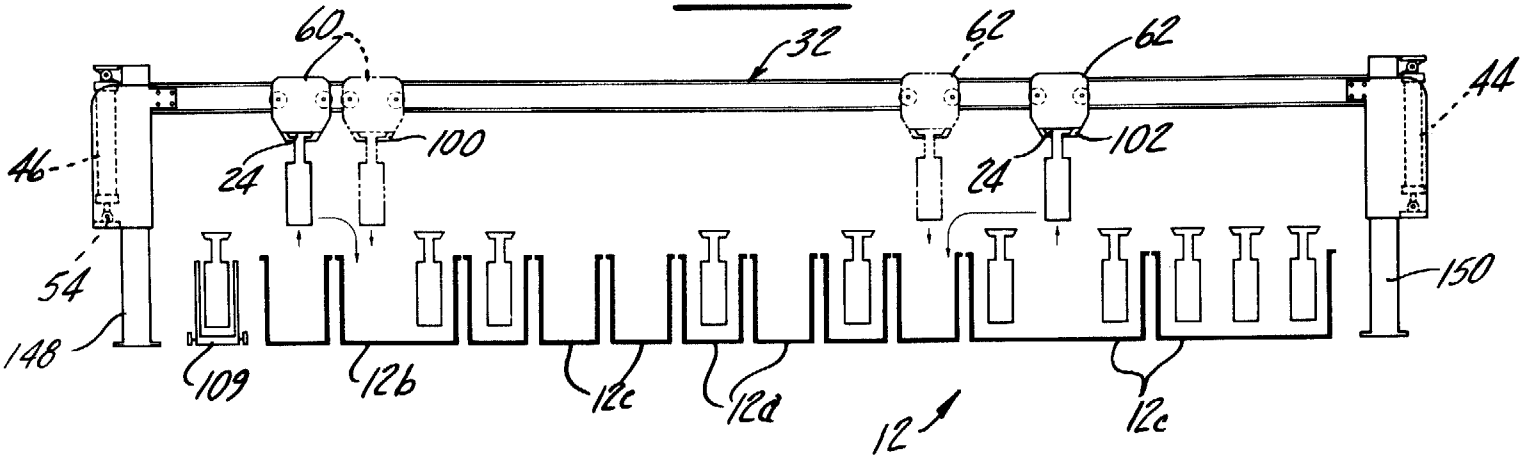
FIGS. 4 and 5 are schematic illustrations useful in understanding operation of the embodiment of the invention illustrated in FIGS. 1-3.
Figure 4:
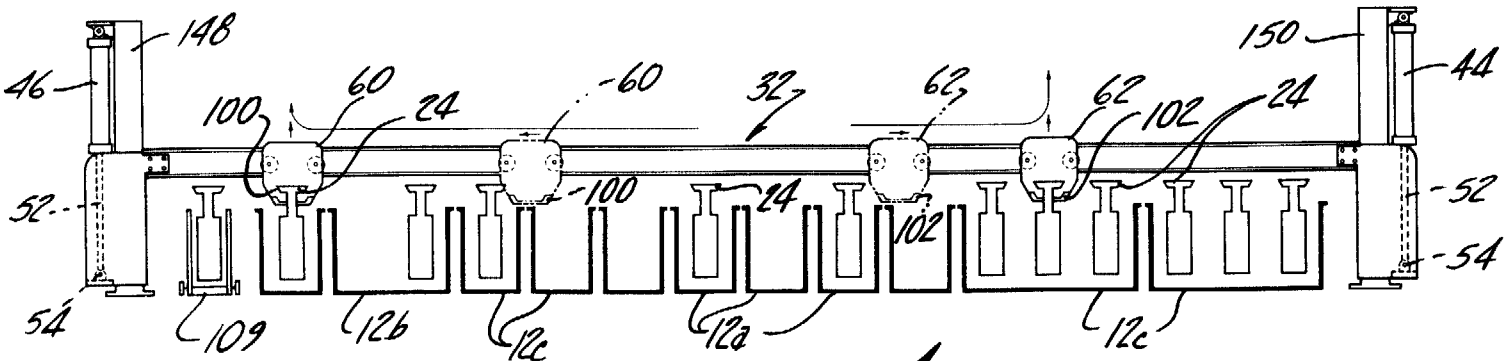

Operation of the single-beam hoist plating line in accordance with the invention will be best understood with reference to FIGS. 4 and 5. In FIGS. 4 and 5, the tanks 12 are illustrated as including a number of tanks **12*a* associated with a single plating location, other tanks 12*b* which are of sufficient dimension lengthwise of the plating line to accommodate two plating locations and third tanks 12*c* which are able to accommodate three plating locations. In FIG. 4, the track 32 is in the lowered position and the carts 60,62 are independently operated by electrical control 82 (FIG. 1) as previously described so as to translate along track 32 to prespecified locations. In the lowered position of track 32, the pick-up hands 100,102 on carts 60,62 travel in a plane disposed beneath the plane of pick-up adapters 24 (and 26) associated with each workpiece, so that the cart pick-up hands pass beneath the workpiece pick-up adapters as the carts translate along track 32 as illustrated in phantom lines in FIG. 4. When the carts reach the preselected plating positions illustrated in solid lines in FIG. 4 and identified by fingers 88,90 (FIG. 1) in cooperation with proximity detectors 92,94 and electrical control circuit 82, the carts are stopped. The hydraulic cylinders 44,46 are then actuated by hydraulic control 56 (FIG. 1) so that the cart pick-up hands 100,102 embrace the pick-up adapters 24 (and 26) as track 32** moves upwardly, and thereby lift the workpiece at each cart position out of the associated plating tank.

In the upper position of track 32 as shown in FIG. 5, the carts 60,62 carry the workpieces above the plane of the pick-up adapters 24 associated with the remaining workpieces, so that the carried workpieces may be translated independently to second prespecified plating locations under control of electric control circuit 82 (FIG. 1). At such second prespecified locations, corresponding to the phantom illustrations in FIG. 5, the carts are again halted and the beam 32 is lowered by hydraulic cylinders 44,46 so as to deposit the workpieces in the second plating locations. The carts may then again translate longitudinally of the track in the manner shown and previously described in connection with FIG. 4 so as to move to other workpieces for repositioning among the various tanks 12 or to a cart illustrated at 109 for finished workpieces.

It will be noted in particular in connection with FIGS. 4 and 5 that the carts 60,62 in accordance with the invention are of sufficiently small dimension lengthwise of track 32 as to permit location of the same at two closely adjacent tank locations. This may be contrasted with prior art chain-type hoist apparatus which require substantial longitudinal dimension and often do not permit the respective pick-up mechanisms to act upon workpieces at longitudinally adjacent plating locations. Additionally, it will be recognized that the hoist mechanism 30 may readily be scaled upwardly or downwardly to accommodate plating lines of various dimensions. For extremely long plating lines, it would be preferable to construct track 32 as a truss-like structure for added strength and minimum weight. It is also contemplated for extremely long plating lines that a multiplicity of chain loop arrangements may be provided on each side of the track so as to operate a corresponding multiplicity of carts.

Figure 6:
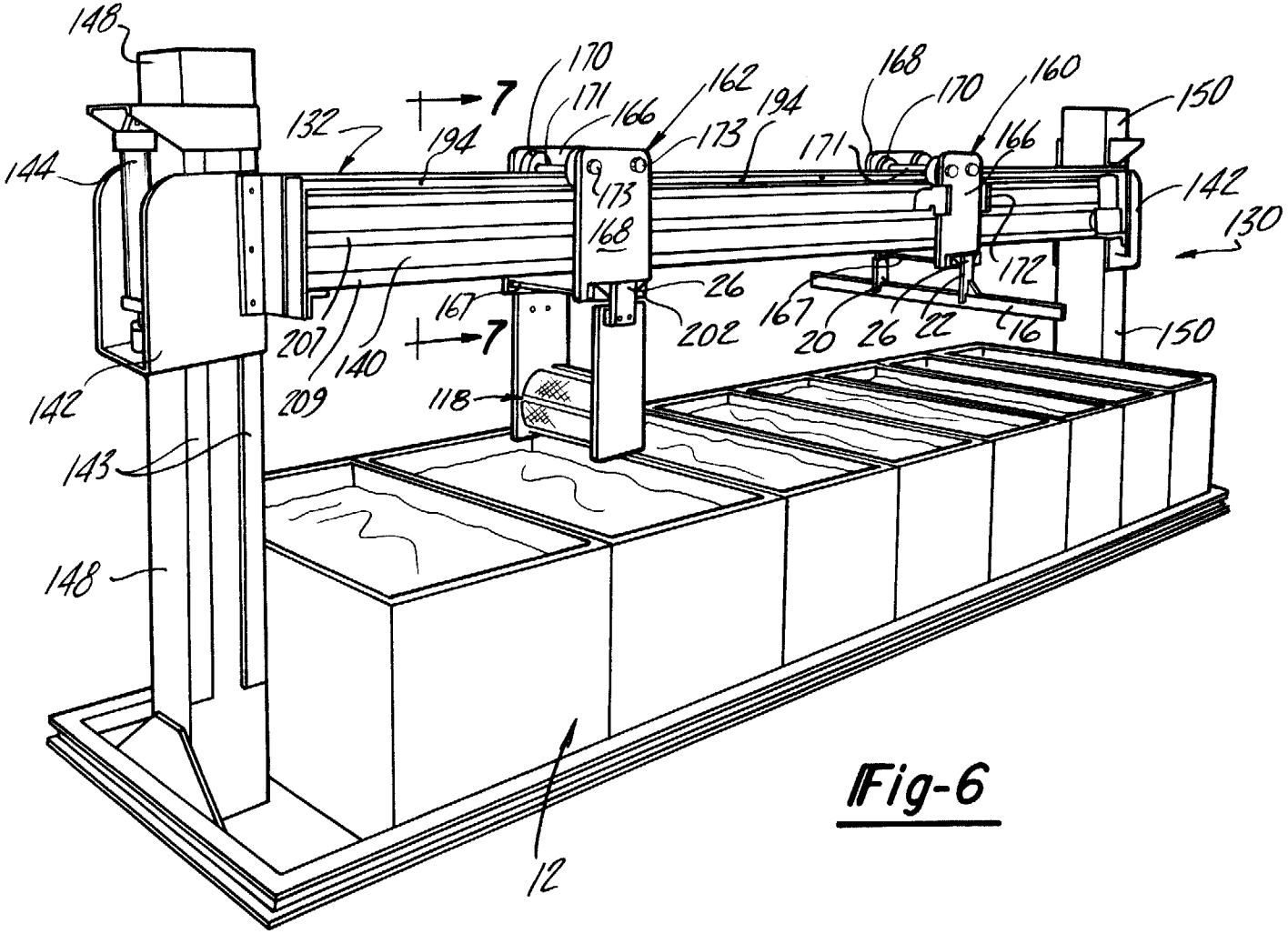
FIG. 6 is a perspective view of a plating line and hoist in accordance with a modified embodiment of the invention.
Figure 7:
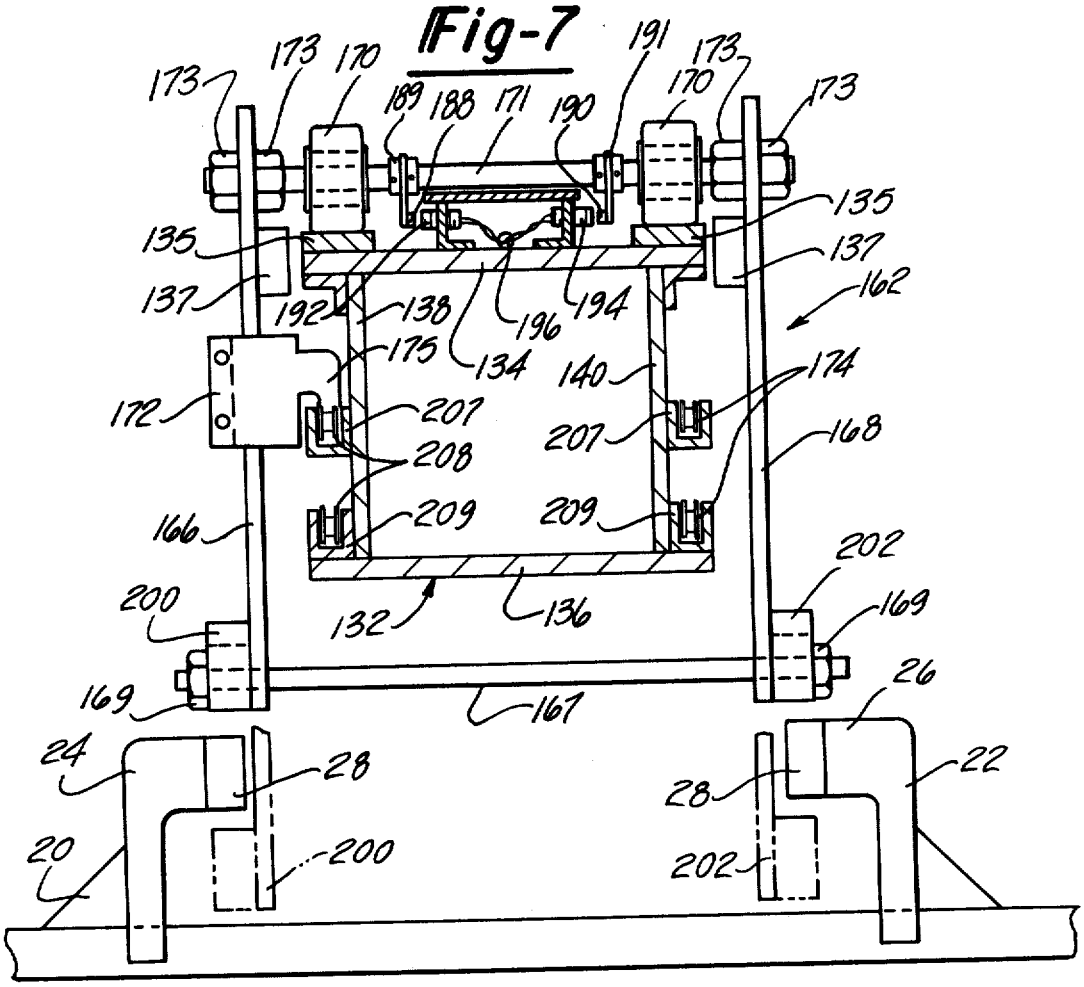
FIG. 7 is a sectional view taken along the line 7—7 in FIG. 6.

FIGS. 6 and 7 illustrate an alternative embodiment 130 of the hoist in accordance with the invention which is particularly useful for smaller plating lines and lighter work loads. As best seen in FIG. 7, the cart 162 in the alternative embodiment comprises a pair of side plates 166,168 connected beneath the lower plate 136 of track 132 by the longitudinally spaced connecting rods 167. The pick-up hands 200,202 are separately but rigidly coupled to the lower external faces of side plates 166,168 by rods 167 and the nuts 169 threaded onto the axial ends thereof. Four castors 170 are mounted in laterally spaced longitudinally pairs to free wheel on the castor axles 171, which extend laterally between the upper edges of side plates 166,168 and are fastened thereto as by the nuts 173. Longitudinally extending fingers 188,190 are suspended from axles 171 as by the brackets 189,191. A plurality of electromagnetic proximity detectors 192,194 are mounted in a longitudinal series of laterally outwardly extending pairs and cooperate with fingers 188,190 for identifying the location of cart 162 on track 132 in the manner previously described. Castors 170 ride on a pair of wear strips 135 mounted on the upper surface of beam upper plate 134. A pair of wear strips 137 are mounted internally of side plates 166,168 laterally adjacent the outer edges of track upper plate 134.

A pair of vertically spaced longitudinally extending channels 207,209 are mounted externally of the beam sides plates 138,140 to act as tracks for the upper and lower reaches of the drive chains 174,208 associated with carts 160,162 respectively. A pair of hands 172 are mounted on the longitudinally spaced side edges of cart side plate 166 and have inwardly and downwardly extending fingers 175 for coupling cart 162 to chain 208 internally of channel 207. Cart 160 is identical to cart 162. Referring to FIG. 6, track 132 is suspended by the hydraulic cylinders 144 (and 146, not shown) from the vertical support stanchions 148,150. A box-like structure 142 comprising a pair of side plates are affixed to the ends of track 132 and encompass stanchion 148 for guiding vertical motion of track 132 as previously described. The side plates of structures 142 ride on wear strips 143 affixed to stanchions 148.

From the foregoing description it will be appreciated that one important aspect of the present invention contemplates an improved hoist in a material finishing line. Directional language in the following claims, such as "longitudinal" or "lateral" are taken with reference to the longitudinal or linear dimension of the array of tanks in a plating line, for example. In practice electrical or hydraulic motors will be used at 80,106 (FIGS. 1 and 2). Cylinders 44,46 may be pneumatic or air over oil.

The invention claimed is:

1. A material finishing line comprising a plurality of tanks disposed in a linear array and adapted to contain material finishing solutions, carrier means for suspending material in said tanks, elongated track means extending longitudinally above said tanks and comprising a rigid linear beam having longitudinally spaced beam ends, means for bodily moving said track means vertically above said tanks between raised and lowered positions including means for guiding vertical movement of said track means between said raised and lowered positions and means for preventing longitudinal movement of said track means at all positions of said track means, cart means carried by said track means for movement longitudinally along said track means above said tanks between limits defined by said beam ends, drive means carried on longitudinal ends of said track means for vertical movement conjointly with said track means and coupled to said cart means for selectively driving said cart means in either direction along said track means in both said raised and said lowered positions of said track means and variably positioning said cart means relative to said tank locations in both said raised and lowered positions, and means rigidly mounted to said cart means and adapted to cooperate with said carrier means for selectively lifting said carrier means and material suspended from said carrier means, transporting said carrier means and material suspended from said carrier means longitudinally above said tanks, lowering said carrier means and material, and releasing said carrier means and material in said lowered position of said track means.

2. The material finishing line set forth in claim 1 wherein said tanks are disposed in predetermined locations in said linear array, and wherein said finishing line further comprises position indicating means carried at fixed longitudinally spaced positions on said track means corresponding to said predetermined locations in said array and means carried by said cart means for cooperating with said position indicating means to identify locations of said cart means on said track means relative to said tank locations.

3. The material finishing line set forth in claim 1 wherein said means for bodily moving said track means includes fixed support means respectively disposed adjacent said opposite longitudinal ends of said beam in line with said beam for preventing motion of the beam in the direction of its length, first and second linear drive means mounting said ends of said beam to said support means and means for simultaneously operating said first and second linear drive means for both raising and lowering said beam.

4. The material finishing line set forth in claim 1, 2 or 3 wherein said carrier means comprises a carrier bar adapted to span each of said tanks at said tank locations, means for suspending material from said carrier bar and pick-up adapter means projecting upwardly from said carrier bar, said pick-up adapter means including first means cantilevered parallel to and spaced above said carrier bar, and wherein said means rigidly mounted on said cart means comprises second means fixedly suspended beneath said cart means and third means cantilevered from said second means at a predetermined fixed distance below said cart means at a position to be disposed beneath said first means in said lowered position of said track means so as to pass horizontally beneath said first means as said cart is driven along said track means in said lowered position, said second means being adapted to cooperate with said first means for lifting and transporting said carrier means.

5. In hoist apparatus for lifting, transporting and depositing work loads among a plurality of coating tanks in a coating line, each said work load including carrier means, said hoist comprising elongated track means extending horizontally over said plurality of coating tanks, cart means carried by said track means and including first means for moving said cart means lengthwise along said track means over said tanks, said cart means including pick-up means adapted to cooperate with said carrier means for supporting a said work load, the improvement comprising second means mounting said track means for vertical bodily movement between a lowered position wherein said pick-up means is disposed to pass beneath said carrier means as said cart means move along said track means and a raised position in which said cart means and said pick-up means are disposed to support said carrier means and a said work load for transportation above said tanks, said second means including third means for preventing movement of said track means in the direction of its length at all positions of said track means, and wherein said first means comprises drive means carried on one longitudinal end of said track means and means extending along said track means coupling said drive means to said cart means for moving said cart means independently of said second means in both said raised and said lowered positions of said track means.

6. Hoist apparatus for lifting, transporting and depositing loads among a plurality of locations disposed in a linear array comprising a rigid linear beam extending longitudinally above said plurality of locations and having longitudinally spaced beam ends, at least one cart carried on said beam for movement between limits defined by said beam ends, first means for selectively driving said cart lengthwise of said beam in either direction over said plurality of locations, second means disposed adjacent said longitudinal ends of said beam for bodily moving said beam in a vertical plane between raised and lowered positions with respect to said locations, said second means including third means disposed in opposition to said opposite longitudinal ends in line with said beam for preventing movement of said beam in the direction of its length, and control means coupled to said first and second means for selectively moving said cart in either direction beneath a first load at a first location in said lowered position of said beam, raising said beam to said raised position so as to lift said first load, moving said cart in either direction along said beam to a second location and then lowering said beam so as to deposit said first load at said second location, said cart being adapted to release said first load at said second location such that said cart and said beam may be selectively controlled by said control means to transport other loads in either direction with respect to said linear array of locations while said first load remains at said second location.

7. Hoist apparatus for lifting, transporting and depositing loads among a plurality of locations disposed in a linear array comprising a rigid linear beam extending longitudinally above said plurality of locations and having longitudinally spaced beam ends, first and second carts carried on said beam for movement lengthwise of said beam between limits defined by said beam ends, first means comprising first and second drive means each including a motor mounted at a said end of said beam, first and second drive chains respectively mounted on opposite lateral sides of said beams and fixedly attaching said first and second motors to said first and second carts for selectively driving said carts lengthwise of said beam in either direction over said plurality of locations, second means disposed adjacent said longitudinal ends of said beam for bodily moving said beam in a vertical plane between raised and lowered positions with respect to said locations, said second means including third means disposed in opposition to said opposite longitudinal ends in line with said beam for preventing movement of said beam in the direction of its length, and control means coupled to said first and second means for moving one of said carts beneath a first load at a first location in said lowered position of said beam, raising said beam to said raised position so as to lift said first load, moving said cart along said beam to a second location and then lowering said beam so as to deposit said first load at said second location, said control means comprising means coupled to said first and second motors for moving said first and second carts lengthwise of said beam independently of each other.

8. Hoist apparatus for lifting, transporting and depositing loads among a plurality of locations disposed in a linear array comprising a rigid linear beam extending longitudinally above said plurality of locations and having longitudinally spaced beam ends, at least one cart carried on said beam for movement between limits defined by said beam ends, first means for selectively driving said cart lengthwise of said beam in either direction over said plurality of locations, second means disposed adjacent said longitudinal ends of said beam for bodily moving said beam in a vertical plane between raised and lowered positions with respect to said locations, said second means including third means disposed in opposition to said opposite longitudinal ends in line with said beam for preventing movement of said beam in the direction of its length, and control means coupled to said first and second means for moving said cart beneath a first load at a first location in said lowered position of said beam, raising said beam to said raised position so as to lift said first load, moving said cart along said beam to a second location and then lowering said beam so as to deposit said first load at said second location, each said cart including a pair of laterally spaced fingers extending in both directions lengthwise of said beam, a first of said fingers being longer than the second said finger, said control means comprising a pair of proximity detectors carried in fixed position on said beam at each of said plurality of locations and spaced from each other in a direction perpendicular to the beam axis, said proximity detectors being coupled to said first means and responsive to approach of said fingers for controlling motion of said cart, all active components of said control means and said drive means for controlling motion of said cart, consisting specifically of said drive means and said proximity detectors, being carried in fixed position on said beam.

9. The apparatus set forth in claim 6 or 8 comprising first and second carts carried for movement lengthwise of said beam, wherein said first means comprises first and second drive means each including a motor mounted at a said end of said beam, first and second drive chains respectively mounted on opposite lateral sides of said beam and fixedly attaching said first and second motors to said first and second carts, and wherein said control means comprises means coupled to said first and second motors for moving said first and second carts lengthwise of said beam independently of each other.

10. The apparatus set forth in claim 6 or 7 wherein said control means comprises a pair of proximity detectors carried in fixed position on said beam at each of said plurality of locations and spaced from each other in a direction perpendicular to the beam axis, wherein each said cart includes a pair of laterally spaced fingers extending in both directions lengthwise of said beam, a first of said fingers being longer than the second said finger, and wherein said control means comprises means coupled to said first means and responsive to approach of said fingers for controlling motion of said cart, all active components of said control means and said drive means for controlling motion of said cart, consisting specifically of said drive means and said proximity detectors, being carried in fixed position on said beam.

* * * * *